US007296454B2

(12) United States Patent
Otaki

(10) Patent No.: US 7,296,454 B2
(45) Date of Patent: Nov. 20, 2007

(54) UPSETTING METHOD AND UPSETTING APPARATUS

(75) Inventor: Atsushi Otaki, Oyama (JP)

(73) Assignee: Showa Denko K K, Tokyo (JP)

( * ) Notice: Subject to any disclaimer, the term of this patent is extended or adjusted under 35 U.S.C. 154(b) by 0 days.

(21) Appl. No.: 11/497,339

(22) Filed: Aug. 2, 2006

(65) Prior Publication Data

US 2007/0089471 A1 Apr. 26, 2007

Related U.S. Application Data

(60) Provisional application No. 60/706,783, filed on Aug. 10, 2005.

(30) Foreign Application Priority Data

Aug. 3, 2005 (JP) ..... 2005-224969

(51) Int. Cl.
*B21C 23/00* (2006.01)

(52) U.S. Cl. ..... 72/256; 72/254; 72/257; 72/271

(58) Field of Classification Search ..... 72/256, 72/260, 254, 257, 263, 271; 264/167, 176.1, 264/177.1, 210.1, 210.2; 425/377, 380, 381
See application file for complete search history.

(56) References Cited

U.S. PATENT DOCUMENTS 2,763,370 A * 9/1956 Kreidler ..... 72/28.1
2,950,817 A * 8/1960 Graham ..... 72/261
3,255,623 A * 6/1966 Ricks ..... 72/256

(Continued)

FOREIGN PATENT DOCUMENTS

JP 07-016643 1/1995

(Continued)

*Primary Examiner*—Ed Tolan
(74) *Attorney, Agent, or Firm*—Oblon, Spivak, McClelland, Maier & Neustadt, P.C.

(57) ABSTRACT

An upsetting method high in productivity of an upsetting manufactured product is provided. An extruder 11 and a closed-die 20 divided into two pieces are prepared. The divided members 21 and 21 of the closed-die are combined with each other so that the tip end portion of an extrusion nozzle 13 is arranged in a cavity 25 of the closed-die 20 with the extruded raw material 1 extruded from the extrusion opening 15 of the extrusion nozzle 13 of the extruder 11. With this, the closed-die 20 is formed, and the extruded raw material 1 is clamped by and between clamping portions 22 and 22 provided at both the divided members 21 and 21. Subsequently, while extruding the extruded raw material 1 from the extrusion opening 15 of the extrusion nozzle 13 by the extruder 11, both the divided members 21 and 21 are moved in the forward direction with respect to the extrusion direction of the extruded raw material 1 at a speed slower than the extrusion speed in a state in which the extruded raw material 1 is clamped by and between the clamping portions 22 and 22 of both the divided members 21 and 21. Thereby, the exposed portion 2 of the extruded raw material 1 exposed between the extrusion opening 15 of the extrusion nozzle 13 and the clamping portions 22 of both the divided members 21 and 21 is expanded in diameter in the cavity 25.

13 Claims, 6 Drawing Sheets

U.S. PATENT DOCUMENTS

| | | | | | |
|---|---|---|---|---|---|
| 3,422,648 | A | * | 1/1969 | Lemelson | 72/17.2 |
| 3,585,834 | A | * | 6/1971 | De Bruyn et al. | 72/260 |
| 5,490,408 | A | * | 2/1996 | Ando et al. | 72/256 |
| 6,116,074 | A | * | 9/2000 | Thoms et al. | 72/256 |

FOREIGN PATENT DOCUMENTS

| | | |
|---|---|---|
| JP | 07-506768 | 7/1995 |
| JP | 09-155491 | 6/1997 |
| JP | 09-253782 | 9/1997 |
| JP | 2005-059097 | 3/2005 |
| JP | 2005-68538 | 3/2005 |
| JP | 2005-144554 | 6/2005 |
| WO | 93/17808 | 9/1993 |

* cited by examiner

UPSETTING METHOD AND UPSETTING APPARATUS

This application claims priority to Japanese Patent Application No. 2005-224969 filed on Aug. 3, 2005, and U.S. Provisional Application No. 60/706,783 filed on Aug. 10, 2005, the entire disclosures of which are incorporated herein by reference in their entireties.

CROSS REFERENCE TO RELATED APPLICATIONS

This application is an application filed under 35 U.S.C. §111(a) claiming the benefit pursuant to 35 U.S.C. §119(e)(1) of the filing date of U.S. Provisional Application 60/706,783 filed on Aug. 10, 2005, pursuant to 35 U.S.C. §111(b).

FIELD OF THE INVENTION

The present invention relates to an upsetting method and an upsetting apparatus used in manufacturing a product having a diameter expanded portion, such as, e.g., an arm, a connecting rod, or a piston for vehicles (e.g., cars, railroad vehicles, etc.).

DESCRIPTION OF THE RELATED ART

In general, upsetting is executed to expand a diameter of a processing scheduled portion of a bar-shaped raw material by pressurizing the raw material in the axial direction thereof. In this upsetting, if the material buckles during the upsetting, the obtained product (upsetting manufactured product) becomes poor in shape (e.g., wrinkles, scratches, etc.), which causes degradation in value as a product. Therefore, in order to prevent the occurrence of such buckling, the following upsetting method is conventionally known.

That is, in this method, a raw material is secured to a fixing die, and the processing scheduled portion of the raw material is inserted into an insertion hole formed in a guide to be held in a buckling prevention state. Subsequently, the guide is moved in a direction opposite to a punch moving direction while pressurizing the processing scheduled portion of the raw material in the axial direction with a punch, to thereby radially expand the processing scheduled portion of the raw material exposed between the tip end portion of the guide and the fixing die (see Patent Documents 1 to 4).

In this upsetting method, in cases where the diameter expansion scheduled portion of the raw material is expanded within a cavity (molding dented portion) of a closed-die, this upsetting method is classified into the category of a constrain upsetting method. According to this constrain upsetting method, it is possible to manufacture a preform having a configuration as close as possible to a desired product configuration. Consequently, there is an advantage that the material yield can be improved and the number of manufacturing steps can be reduced.

Patent Document 1 Japanese Unexamined Laid-open Patent Publication No. H09-253782

Patent Document 2 Japanese translation of PCT international application No. H07-506768

Patent Document 3 Japanese Unexamined Laid-open Patent Publication No. 2005-59097

Patent Document 4 Japanese Unexamined Laid-open Patent Publication No. 2005-144554

In the upsetting, a raw material made of, for example, an extruded material is used. In the case of manufacturing an upsetting manufactured product by the above-mentioned conventional constrain upsetting method using the raw material, the raw material is initially extruded by an extruder. Thereafter, the obtained raw extruded material is conveyed to a constrain upsetting apparatus and set thereto. And then, upsetting is executed to this set raw material. In other words, the step of manufacturing the raw material and the step of upsetting the raw material were performed separately, and therefore the upsetting manufactured product was low in productivity.

DISCLOSURE OF THE INVENTION

The preferred embodiments of the present invention have been developed in view of the above-mentioned and/or other problems in the related art. The preferred embodiments of the present invention can significantly improve upon existing methods and/or apparatuses.

The present invention was made in view of the aforementioned technical background, and aims to provide an upsetting method high in productivity of a upsetting manufactured product, an upsetting manufactured product obtained by the method, and an upsetting apparatus used for the method.

Other objects and advantages of the present invention will be apparent from the following preferred embodiments.

The present invention provides the following means.

[1] An upsetting method using an extruder equipped with an extrusion nozzle having an extrusion opening at a tip end portion of the extrusion nozzle and a closed-die having a cavity, the closed-die being divided into a plurality of closed-die divided members, the upsetting method, comprising:

a clamping step of forming the closed-die by combining the plurality of closed-die divided members so that the tip end portion of the extrusion nozzle is arranged in the cavity with an extruded raw material extruded from the extrusion opening of the extrusion nozzle of the extruder and clamping the extruded raw material with clamping portions provided at the plurality of closed-die divided members; and a diameter expansion step of extruding the extruded raw material from the extrusion opening of the extrusion nozzle with the extruder and expanding an exposed portion of the extruded raw material exposed between the extrusion opening of the extrusion nozzle and the clamping portions of the plurality of divided members while filling the cavity with a material of the exposed portion by moving the plurality of closed-die divided members in a forward direction with respect to an extrusion direction of the extruded raw material relative to the extrusion opening of the extrusion nozzle at a speed slower than an extrusion speed with the extruded raw material clamped by and between the clamping portions of the plurality of divided members.

[2] The upsetting method as recited in the aforementioned Item 1, wherein at the clamping step, the extruded raw material is clamped by and between the clamping portions of the plurality of divided members at a position where a length of the exposed portion of the extruded raw material is not longer than a buckling limit length of the exposed portion.

[3] The upsetting method as recited in the aforementioned Item 1 or 2, wherein at the diameter expansion step, a time lag is set between initiation of clamping the extruded raw material by the clamping portions of the plurality of divided members at the clamping step and initiation of moving the plurality of divided members.

[4] The upsetting method as recited in the aforementioned Item 3, wherein a clamped portion of the extruded raw material or a portion of the extruded raw material located ahead of the clamped portion is cut during the time lag with the extruded material clamped by and between the clamping portions of the plurality of divided members.

[5] The upsetting method as recited in any one of the aforementioned Items 1 to 4, wherein a slip prevention means is provided at the clamping portion of at least one of the plurality of divided members.

[6] The upsetting method as recited in the aforementioned Item 5, wherein a biting protrusion for biting the extruded raw material as the slip prevention means is provided at the clamping portion of at least one of the plurality of divided members.

[7] The upsetting method as recited in any one of the aforementioned Items 1 to 6, further comprising:

a clamp release step of releasing clamping of the extruded raw material by the clamping portions of the plurality of divided members after the diameter expansion step; and a return step of returning the plurality of divided members to the initial position after the clamp releasing step, wherein the clamping step, the diameter expansion step, the clamp releasing step, and the return step are repeatedly performed in order.

[8] An upsetting manufactured product obtained by the upsetting method as recited in any one of the aforementioned Items 1 to 7.

[9] An upsetting apparatus, comprising:

an extruder provided with an extrusion nozzle having an extrusion opening at a tip end portion of the extrusion nozzle, an extruded raw material being extruded from the extrusion opening of the extrusion nozzle;

a closed-die having a cavity, the closed-die being divided into a plurality of closed-die divided members;

a divided member combining device for combining the plurality of closed-die divided members so that the closed-die is formed; and a driving device for moving the plurality of divided members in a forward direction with respect to an extrusion direction of the extruded raw material by the extruder relative to the extrusion opening of the extrusion nozzle at a speed slower than an extrusion speed with the plurality of divided members combined, wherein the plurality of divided members are provided with a clamping portion, respectively, and wherein the extruded material is clamped by the clamping portions of the plurality of divided members when the plurality of divided members are combined by the divided member combining device.

[10] The upsetting apparatus as recited in the aforementioned Item 9, further comprising a cutting device for cutting a clamped portion of the extruded raw material clamped by and between the clamping portions of the plurality of divided members or a portion of the extruded raw material located ahead of the clamped portion.

[11] The upsetting apparatus as recited in the aforementioned Item 9 or 10, wherein the clamping portion of at least one of the plurality of divided members is provided with a slip prevention means.

[12] The upsetting apparatus as recited in the aforementioned Item 11, wherein the clamping portion of at least one of the divided members is provided with a biting protrusion for biting the extruded raw material as the slip prevention means.

[13] The upsetting apparatus as recited in any one of the aforementioned Items 9 to 12, wherein the divided member combining device is further configured to detach the plurality of divided members combined each other, and wherein the driving device is further configured to return the plurality of divided members moved in the forward direction with respect to the extrusion direction of the extruded raw material relative to the extrusion opening of the extrusion nozzle to their initial positions.

The present invention has the following effects.

According to the invention of Item [1], the step of manufacturing the extruded raw material and the step of upsetting the extruded raw material can be performed continuously, which improves the productivity of the upsetting manufactured product.

Furthermore, since the extrusion force of the extruder is used as a force for pressurizing the extruded raw material in the axial direction to expand the diameter of the exposed portion (i.e., the diameter expansion scheduled portion) of the extruded raw material, a punch and its driving device for pressurizing the raw material in the axial direction, which was used in a conventional upsetting method, are not required separately. Therefore, the upsetting apparatus can be simplified.

Since the exposed portion of the extruded raw material is expanded in diameter in the cavity of the closed-die, a preform having a shape as close as possible to a desired product can be manufactured, which in turn can improve the material yield and can reduce the number of manufacturing steps.

Furthermore, by moving the plurality of divided members in the forward direction with respect to the extrusion direction of the extruded raw material at a speed slower than the extrusion speed with the extruded raw material clamped by and between the clamping portions of the plurality of divided members while filling up the cavity with the material of the exposed portion of the extruded raw material, the flow of the material in the cavity is distributed. Therefore, the corner portion in the cavity of the closed-die can be filled up with the material without excessively increasing the extrusion force of the extruder. This prevents the defect that a non-filled up portion is generated in the cavity, which in turn can obtain a high quality upsetting manufactured product having no underfill defect.

Furthermore, since the corner portion in the cavity of the closed-die can be filled up with a material without excessively increasing the extrusion force of the extruder, the load applied to the closed-die during the processing can be reduced, resulting in an extended service life of the closed-die.

According to the invention of Item [2], buckling of the extruded raw material can be prevented assuredly, resulting in a favorable diameter expansion of the exposed portion of the extruded raw material.

According to the invention of Item [3], the cross-sectional area of the exposed portion of the extruded raw material can be increased at the early stage of the diameter expansion. Therefore, buckling limit length of the exposed portion of the extruded raw material can be extended, which in turn can assuredly prevent occurrence of buckling.

According to the invention of Item [4], when a clamped portion of the extruded raw material or a portion of the extruded raw material located ahead of the clamped portion in the forward direction with respect to the extrusion direction is cut as a cutting scheduled portion, since the portion of the extruded raw material is not moving, the portion of the extruded raw material can be cut easily.

Furthermore, since the cutting of the extruded raw material can be performed while extruding the extruded raw material with the extruder, the installation space for the upsetting apparatus can be saved.

According to the invention of Item [5], the extruded raw material can be clamped firmly.

According to the invention of Item [6], the extrusion raw material can be clamped firmly and assuredly.

According to the invention of Item [7], the productivity of the upsetting manufactured product can be further improved.

According to the invention of Item [8], a high quality upsetting manufactured product with no shape defect, such as, e.g., underfill, wrinkles, or scratches, can be provided.

According to the invention of Items [9] to [13], an upsetting apparatus used suitably for the upsetting method according to the present invention can be provided.

BEST MODE FOR CARRYING OUT THE INVENTION

Next, some embodiments of the present invention will be explained below with reference to the drawings. In the embodiments, for convenience of explanation, "front" means a forward side with respect to an extruding direction of an extruded raw material, and "rear" means a direction opposite to the extruding direction of the extruded raw material.

FIG. 1A to FIG. 3 are figures for explaining an embodiment of the present invention.

Figure 1A:
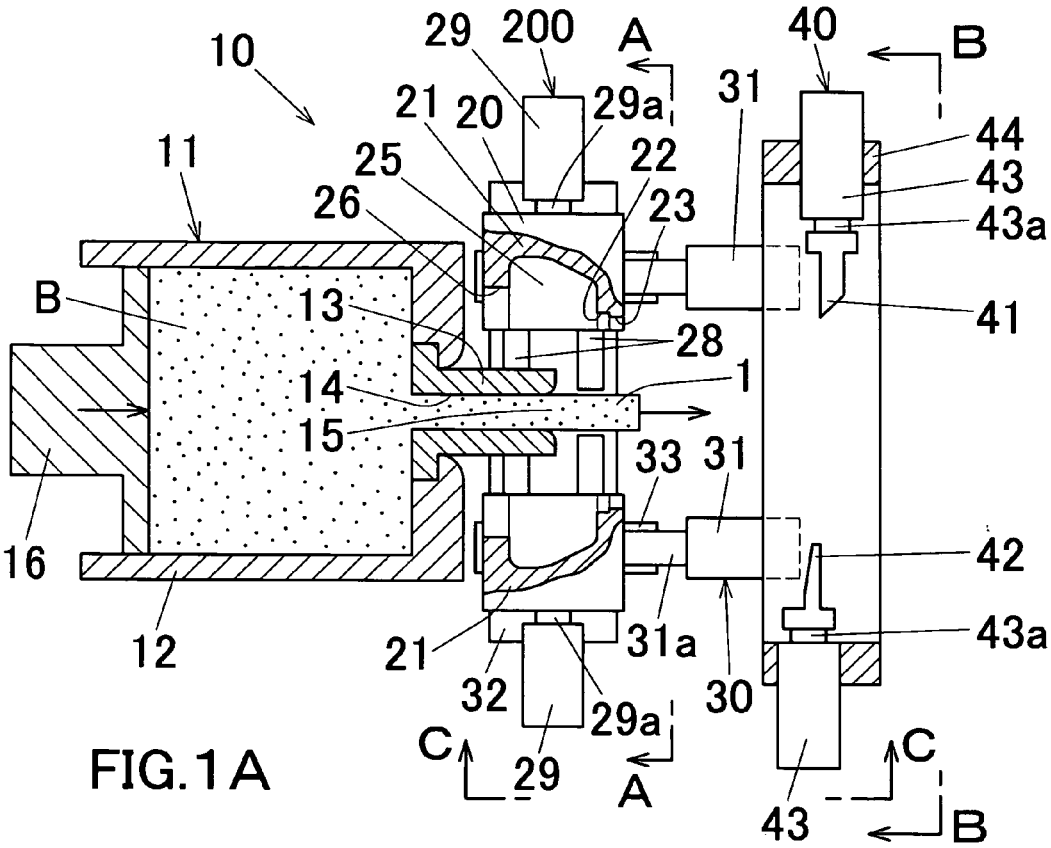
FIG. 1A is a partially cut-out plan view of an upsetting apparatus according to an embodiment of the present invention.

In FIG. 1A, the reference numeral "10" denotes an upsetting apparatus according to this embodiment. This upsetting apparatus 10 is a constrain upsetting apparatus in detail. "1" denotes an extruded raw material.

Figure 3:
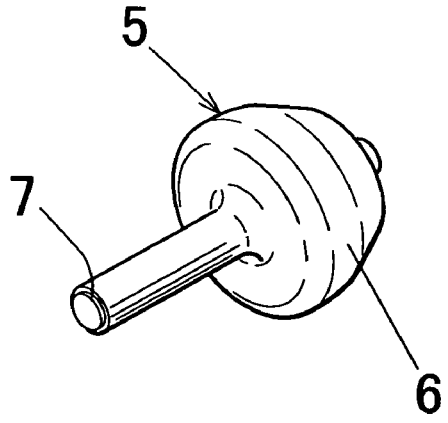
FIG. 3 is a perspective view showing an upsetting manufactured product processed with the aforementioned upsetting apparatus.

In FIG. 3, the reference numeral "5" denotes an upsetting manufactured product processed with the upsetting apparatus 10. In this upsetting manufactured product 5, one diameter expanded portion 6 is formed at a part of the axial direction thereof (in detail, at an end portion). This upsetting manufactured product 5 is used as a preform for manufacturing various products, such as, e.g., an arm, a connecting rod, or a piston for vehicles (cars, railroad vehicles, etc.). As an arm for vehicles, a straight arm, a knuckle, etc., having a connecting portion (for example, a bush mounting portion) to be connected to another component can be exemplified concretely.

As shown in FIGS. 1A and 2A to 2C, the extruded raw material 1 is made of solid bar-shaped aluminum or aluminum alloy extruded material. The extruded raw material 1 is circular in cross-section, and constant in diameter along the axial direction (i.e., extruding direction).

In the present invention, the substance of the extruded raw material 1 is not limited to aluminum or aluminum alloy, and can be metal, such as, e.g., brass, copper, and stainless steel, or can be plastic. Moreover, the cross-sectional shape of the extruded raw material 1 is not limited to a circular shape, and can be a polygon, such as, e.g., a square or a hexagon. Moreover, the extruded raw material 1 is not limited to a solid member, and can be a hollow member.

The diameter of the extruded raw material 1 is, for example, 16 mm. In the upsetting manufactured product 5, for example, the diameter expanded portion 6 is 60 mm in maximum diameter and 45 mm in length. In the present invention, however, the diameter of the extruded raw material 1 and the dimension of each portion of the upsetting manufactured product 5 are not limited to the above-mentioned dimensions. For example, the diameter of the extruded raw material 1 and the dimension of each portion of the upsetting manufactured product 5 can be set depending on the manufacture of products, such as, e.g., an arm, a connecting rod, or a piston for vehicles so that the purposes of the present invention can be attained.

The upsetting apparatus 10 is equipped with an extruder 11, a closed-die 20, and a cutting device 40 as shown in FIG. 1A.

The extruder 11 is for manufacturing the extruded raw material 1. This extruder 11 has a container portion 12, an extrusion nozzle 13, and a stem 16. In the container portion 12, a billet B of aluminum or aluminum alloy is loaded. The stem 16 is for pressurizing the billet B loaded in the container portion 12 in the extruding direction from the rear side. The extrusion nozzle 13 is projected from the container portion 12 in the extruding direction. In this extrusion nozzle 13, a forming hole 14 communicated with the inside of the container portion 12 is extended in the axial direction (i.e., the length direction) of this extrusion nozzle 13. Moreover, the external diameter of the extrusion nozzle 13 is set constant along the axial direction. At the tip end portion of this extrusion nozzle 13, an extrusion opening 15 as an outlet of the forming hole 14 is formed. The cross-sectional shape of the extrusion opening 15 (i.e., forming hole 14) is formed into a shape corresponding to the cross-sectional shape of the extruded raw material 1, i.e., a circular shape.

The closed-die 20 has a closed-cavity 25 for forming a prescribed portion of the extruded raw material 1 into a designed shape. Furthermore, this closed-die 20 is divided into two portions along the axial direction thereof (i.e., extruding direction of the extruded raw material 1), i.e., a pair of right and left closed-die divided members 21 and 21. Both the divided members 21 and 21 are disposed at right and left sides of the extrusion nozzle 13 of the extruder 11 in an opposed manner. Both the divided members 21 are 21 are the same in structure.

Figure 1B:
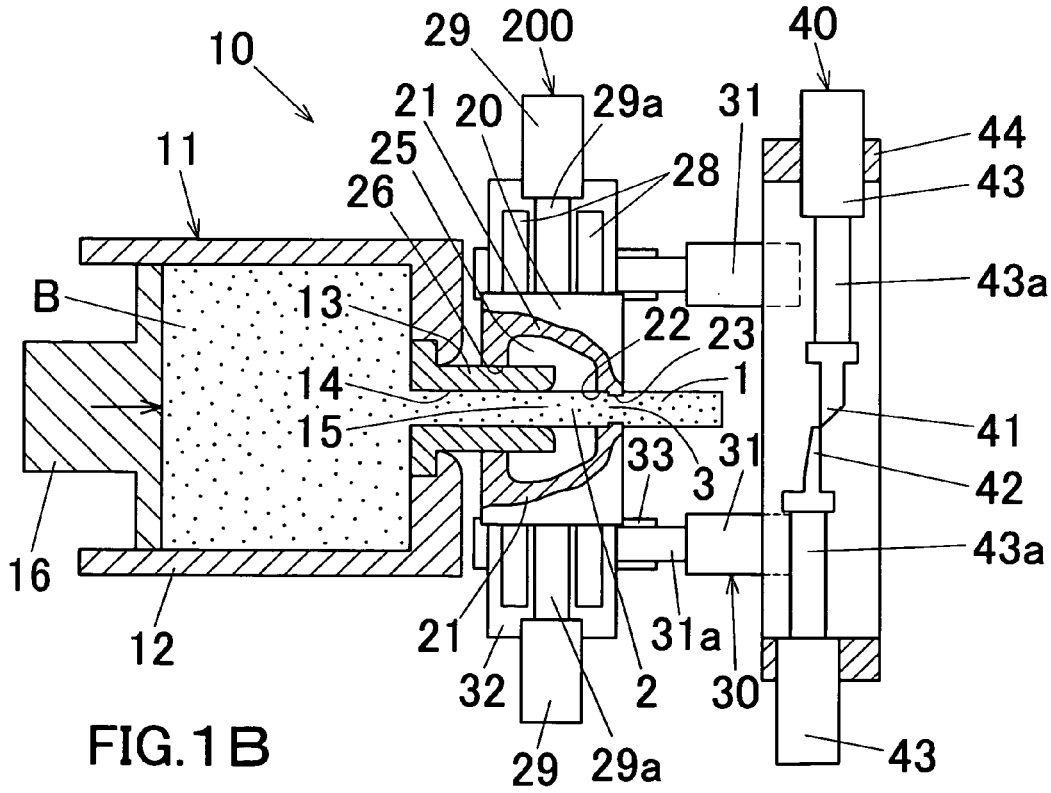
FIG. 1B is a partially cut-out plan view showing the state in which a pair of right and left closed-die divided members of the aforementioned upsetting apparatus are mutually combined.

At the divided portion of the front wall portion of each divided member 21, a clamping portion 22 for clamping the extruded raw material 1 having a dented groove (dented portion) of a semi-circular shape as seen from the front is provided. As shown in FIG. 1B, in a state in which both the divided members 21 and 21 are combined so that the closed-dies 20 are formed, the clamping portions 22 and 22 of both the divided members 21 and 21 clamp the extruded raw material 1. In the state in which the extruded raw material 1 is clamped by and between the clamping portions 22 and 22 of both the divided members 21 and 21, the extruded raw material 1 is fitted in the clamping portions 22 and 22 of both the divided members 21 and 21. At each of the clamping portions 22 and 22 of both the divided members 21 and 21, a biting protrusion 23 for biting the extruded raw material 1 is provided as a slip prevention means with respect to the extruded raw material 1. Therefore, the diameter of the clamping portion 22 is set to be slightly smaller than the diameter of the extruded raw material 1. Therefore, when the extruded raw material 1 is clamped by and between the clamping portions 22 and 22 of both the divided members 21 and 21, the biting protrusion 23 of the clamping portion 22 of each divided member 21 bites into the clamped portion 3 of the extruded raw material 1, which prevents the slip of the extruded raw material 1 in the axial direction.

In this embodiment, although the biting protrusion 23 is provided at the clamping portion 22 of each of the divided members 21 and 21, the present invention allows to provide the biting protrusion 23 only at the clamping portion 22 of any one of the divided members 21. As a means for preventing the slip of the extruded raw material 1 in the axial direction, another means different from the biting protrusion 23 can be provided at the clamping portion 22.

Furthermore, at the divided portion of the back wall portion of each divided member 21, a dented portion 26 which is to be brought into contact with the extrusion nozzle 13 is provided. As shown in FIG. 1B, in the state in which both the divided members 21 and 21 are combined mutually, the extrusion nozzle 13 is fitted in the fitting hole formed by the combination of the dented portions 26 and 26 of both the divided members 21 and 21.

The upsetting apparatus 10 is equipped with a divided member combining device 200 which combines both the divided members 21 and 21 so that the closed-die 20 is formed, and a driving device 30.

The divided member combining device 200 has a pair of right and left fluid pressure cylinders (e.g., hydraulic or gas cylinders) 29 and 29 as a driving source for moving both the divided members 21 and 21 in the approach direction and in the separation direction as well. Each divided member 21 is connected to a rod 29*a* of the fluid pressure cylinder 29. Each divided member 21 is secured to a cradle 27 movable on an LM guide rail 28 extended in a direction perpendicular to the extruding direction of the extruded raw material 1 (see FIG. 2A and FIG. 2C). Both the divided members 21 and 21 are installed on the common movable stage 32 via the corresponding cradles 27 and rails 28. This movable stage 32 is installed so that it can move forward and rearward in the extruding direction of the extruded raw material 1. The reference numeral "33" denotes a rail for the movable stage 32.

This divided member combining device 200 is configured to move both the divided members 21 and 21 in the approach direction by operating the fluid pressure cylinders 29 and 29, to thereby combine both the divided members 21 and 21 to form a closed-die 20 as shown in FIG. 1B. Furthermore, this divided member combining device 200 is configured to move both the combined divided members 21 and 21 in the separation direction by operating the fluid pressure cylinders 29 and 29, to thereby detach both the divided members 21 and 21 to divide the closed-die 20 into two pieces.

Figure 1C:
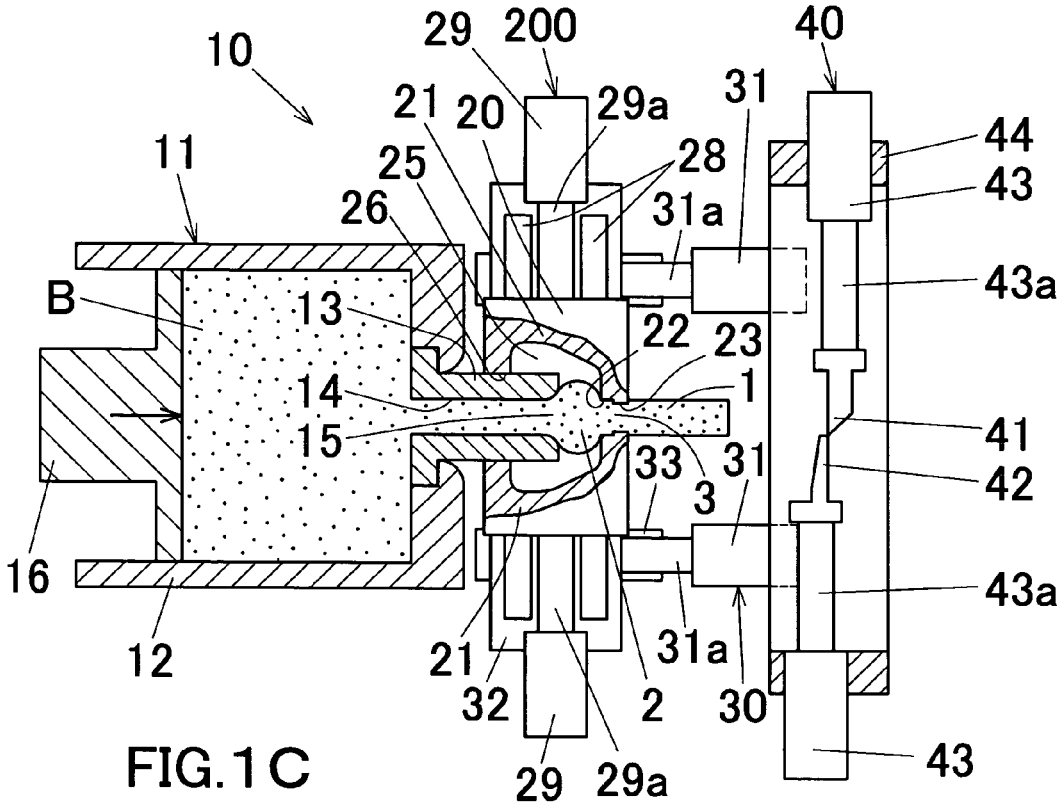
FIG. 1C is a partially cut-out plan view showing the state in the middle of expanding a diameter of an exposed portion of an extrusion raw material with the aforementioned upsetting apparatus during a time lag.
Figure 1D:
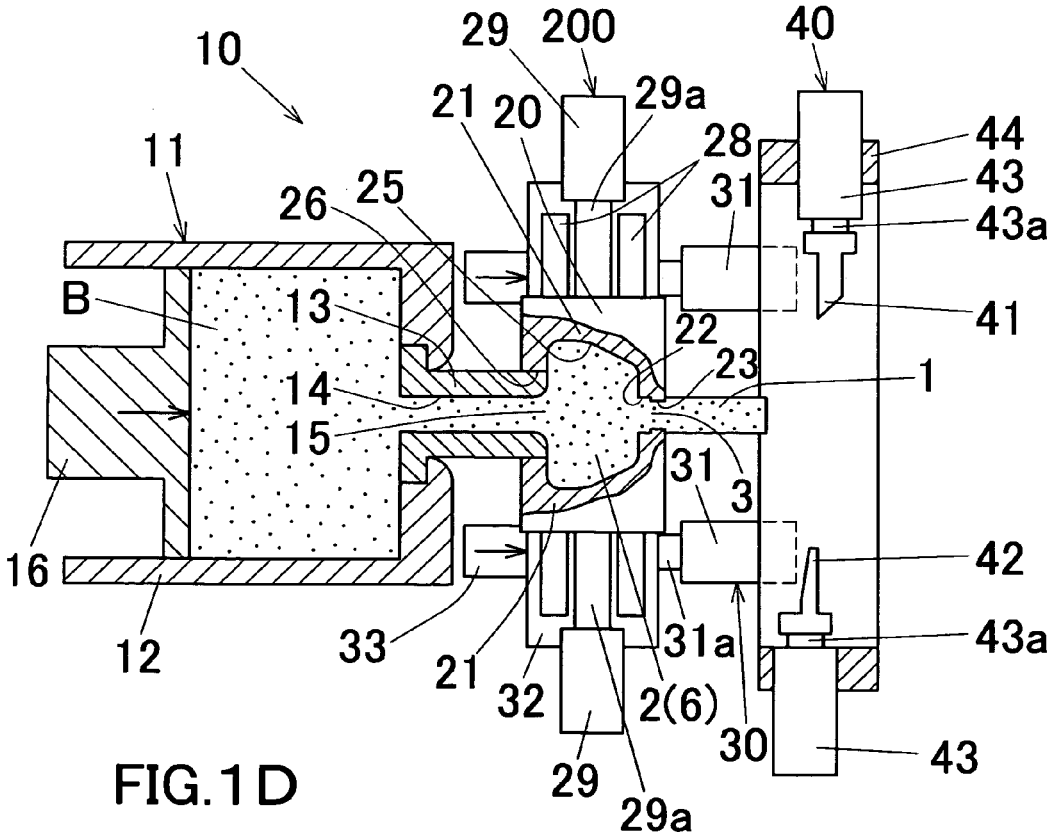
FIG. 1D is a partially cut-out plan view showing the state in which the exposed portion of the extrusion raw material is expanded in diameter with the aforementioned upsetting apparatus.
Figure 1E:
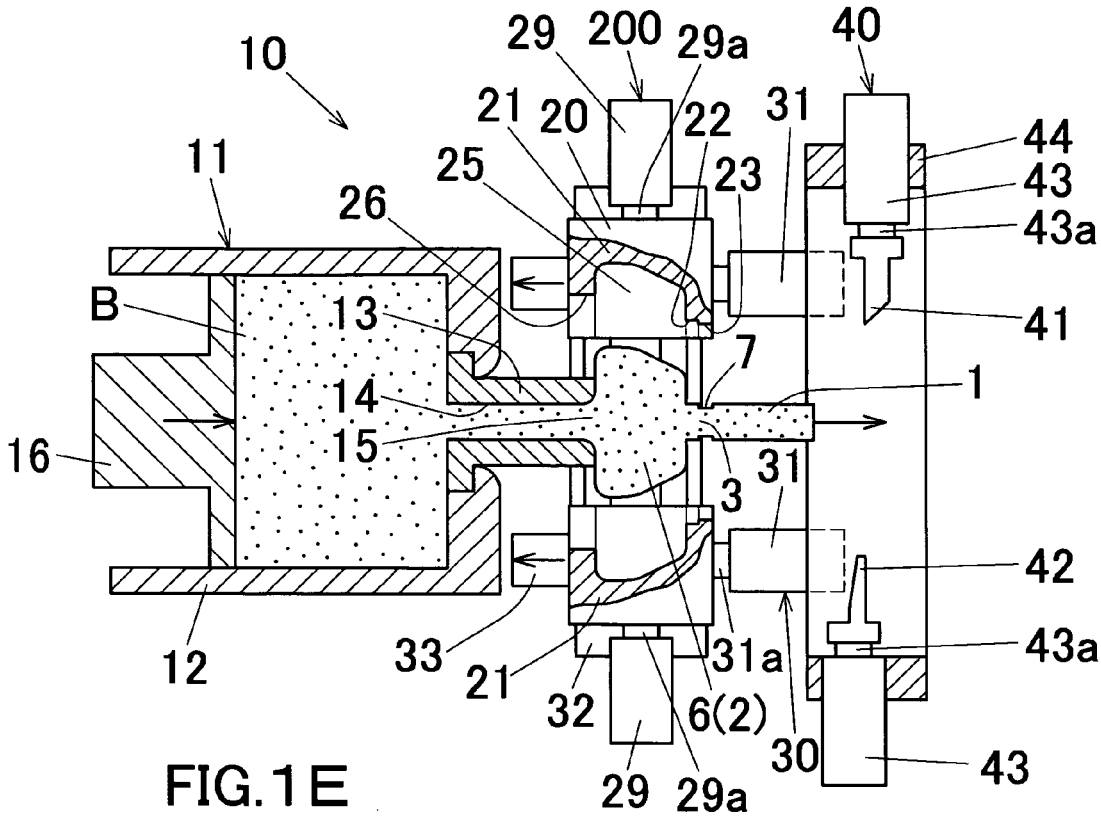
FIG. 1E is a partially cut-out plan view showing the state in which both the divided members of the aforementioned upsetting apparatus are separated.
Figure 1F:
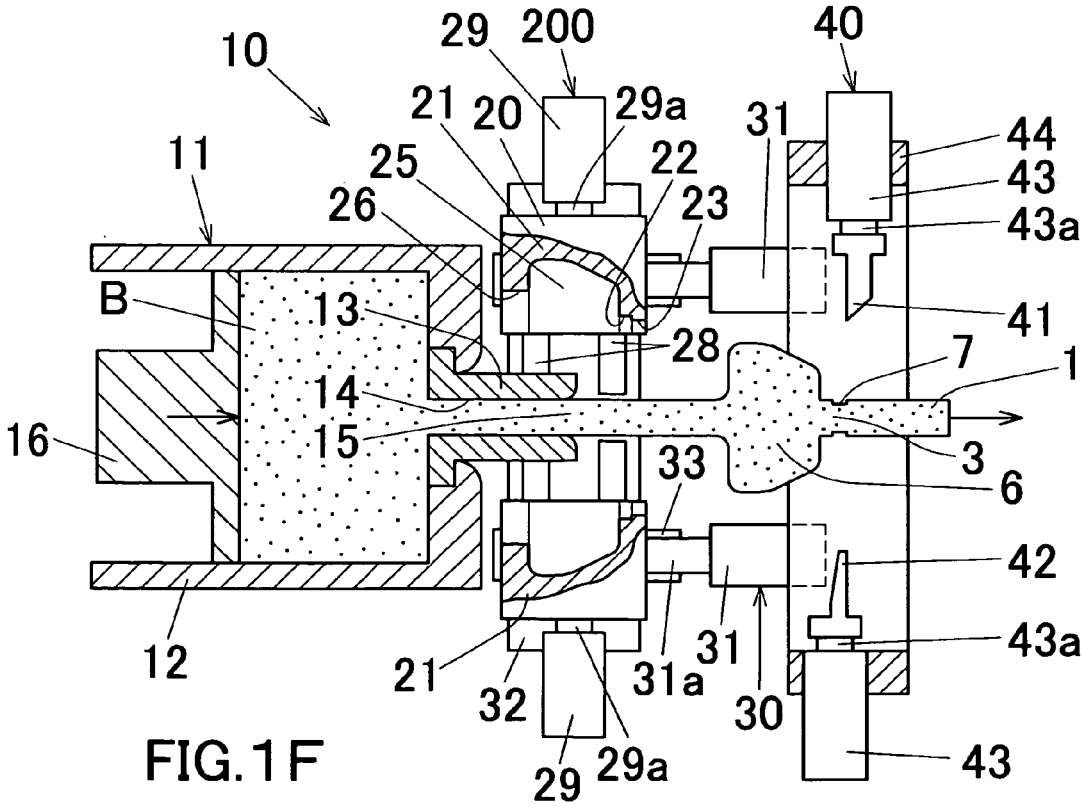
FIG. 1F is a partially cut-out plan view showing the state in which both the divided members of the aforementioned upsetting apparatus are returned to their respective initial positions.

The driving device 30 is for moving both the divided members 21 and 21 while keeping the combined state in a forward direction with respect to the extrusion direction of the extruded raw material 1 at a speed slower than the extrusion speed. As the driving source of this driving device 30, two fluid pressure cylinders (e.g., hydraulic or gas cylinder) 31 and 31 are connected to the movable stage 32. And as shown in FIG. 1C and FIG. 1D, the driving device 30 is configured to move both the divided members 21 and 21 together with the movable stage 32 in a forward direction with respect to the extrusion direction of the extruded raw material 1 at a predetermined speed by operating both the fluid pressure cylinders 31 and 31 so as to retreat the rods 31*a* and 31*a*. Furthermore, as shown in FIG. 1E and FIG. 1F, this driving device 30 is configured to return (move) both the divided members 21 and 21 moved in the forward direction with respect to the extrusion direction of extruded raw material 1 to the respective initial positions by operating both the fluid pressure cylinders 31 and 31 so as to protrude the rods 31*a* and 31*a*.

In the present invention, the driving device 30 can be configured to move the extrusion opening 15 of the extrusion nozzle 13 in the rearward direction with respect to the extrusion direction of the extruded raw material 1 at a speed slower than the extrusion speed. Furthermore, in this case, the driving device 30 can be configured to return (move) the extrusion opening 15 of the extrusion nozzle 13 moved in the rearward direction with respect to the extrusion direction of extruded raw material 1 to the initial position.

The cutting device 40 is configured to cut (in detail, shear) a clamped portion 3 clamped with the clamping portions 22 and 22 of both the divided members 21 and 21 or a portion of the extruded raw material 1 located ahead of the clamped portion 3 in the forward direction with respect to the extrusion direction to separate the diameter expanded portion 6 of the extruded raw material 1 from the extruded raw material 1. The cutting device 40 has a cutting blade (in detail, shearing blade) 41 and a cutting die 42 corresponding to the cutting blade 41.

Figure 1G:
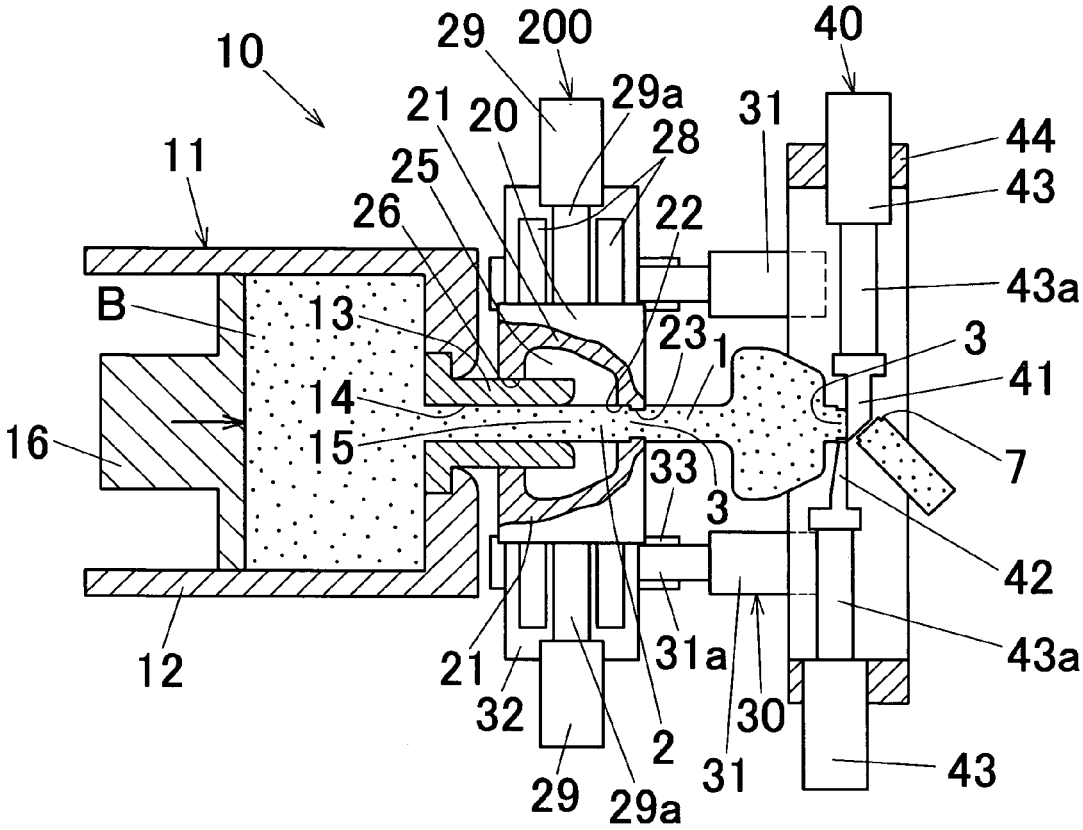
FIG. 1G is a partially cut-out plan view showing the state in which both the divided members of the aforementioned upsetting apparatus are mutually combined again.
Figure 2A:
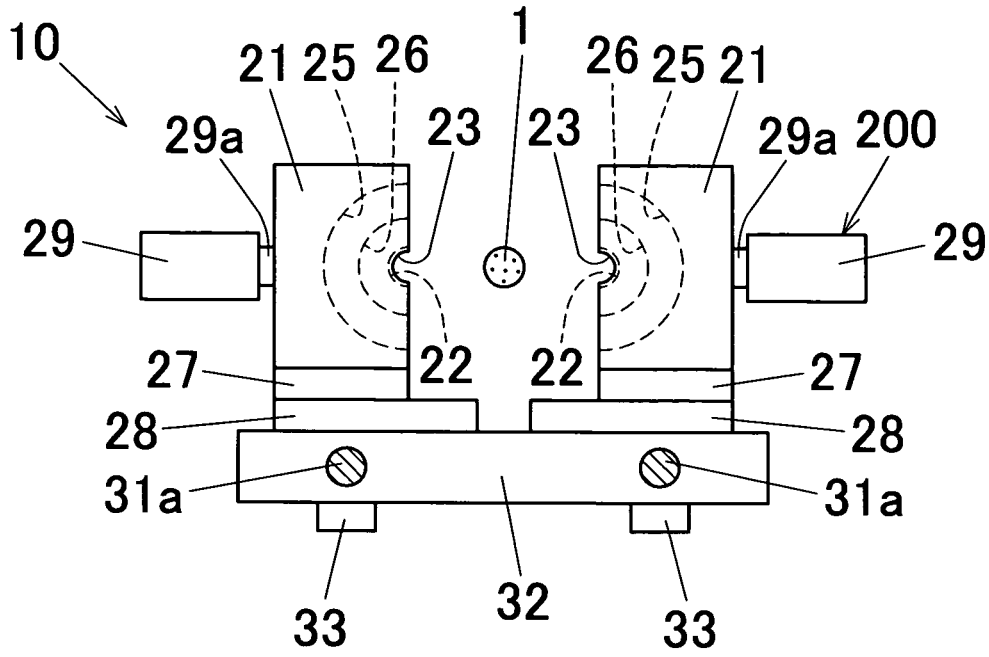
FIG. 2A is a cross-sectional view taken along the line A-A in FIG. 1A.
Figure 2B:
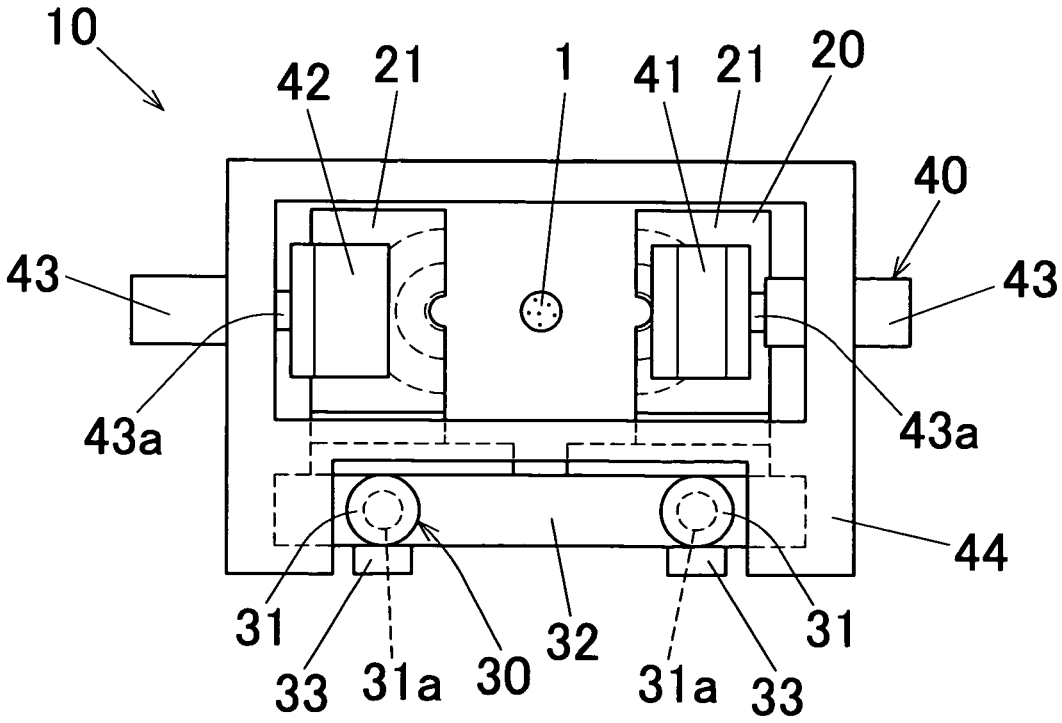
FIG. 2B is a front view as seen from the line B-B in FIG. 1A.
Figure 2C:
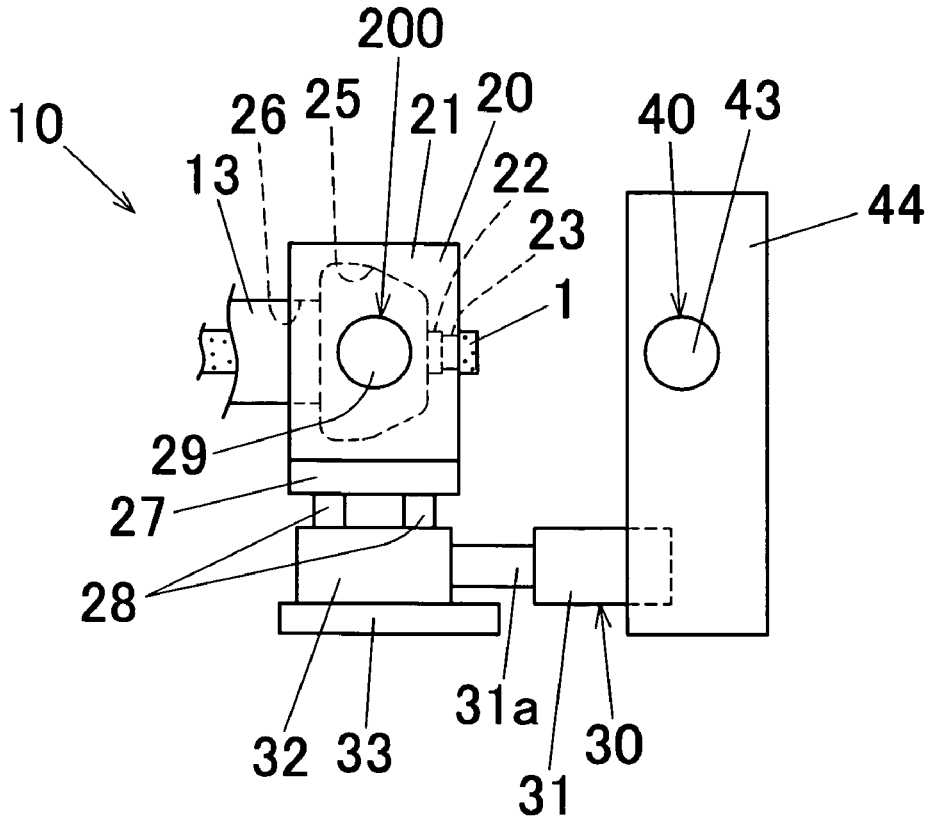
FIG. 2C is a side view as seen from the line C-C in FIG. 1A.

The cutting blade 41 and the cutting die 42 are opposed with each other at the right and left sides of the extruded raw material 1 at the front of both divided members 21 and 21 (i.e., the closed-die 20). Connected to each of the cutting blade 41 and the cutting die 42 is a fluid pressure cylinder (e.g., a hydraulic or gas cylinder) 43 as a driving source. And as shown in FIG. 1G, by protruding the rods 43*a* by operating the fluid pressure cylinders 43, the cutting scheduled portion of the extruded raw material 1 is clamped by and between the cutting blade 41 and the cutting die 42 and cut (sheared) with the cutting blade 41. On the other hand, by retreating the rod 43*a* of the fluid pressure cylinder 43, the cutting blade 41 and the cutting die 42 returns to their respective original positions. The cutting blade 41 and the cutting die 42 are fixedly attached to the frame 44 via the corresponding fluid pressure cylinders 43.

Next, the upsetting method using the aforementioned upsetting apparatus 10 will be explained below.

Initially, as shown in FIG. 1A, both the divided members 21 and 21 of the closed-die 20 are arranged in a separated state. Subsequently, a heated billet B loaded in the container portion 12 of the extruder 11 is pressurized with the stem 16 in the forward direction with respect to the extrusion direction, to thereby extrude the extruded raw material 1 from the extrusion opening 15 of the extrusion nozzle 13. In this embodiment, the extruded raw material 1 is extruded horizontally for example.

Then, as shown in FIG. 1B, in the state in which the extruded raw material 1 is extruded from the extrusion opening 15 of the tip end portion of the extrusion nozzle 13, both the divided members 21 and 21 are mutually combined with the divided member combining device 200 such that the tip end portion of the extrusion nozzle 13 is arranged in the cavity 25. Thus, the closed-die 20 is formed. At the same time, the extruded raw material 1 extruded from the extrusion opening 15 of the extrusion nozzle 13 is clamped by and between the clamping portions 22 and 22 of both the divided members 21 and 21. [Clamping Step]. Then, the biting protrusion 23 of the clamping portion 22 of each divided member 21 bites into the clamped portion 3 of the extruded raw material 1, thereby preventing the slip of the extruded raw material 1 in the axial direction. On the other hand, on the clamped portion 3 of the extruded raw material 1, a bite mark 7 corresponding to the biting protrusion 23 is formed (see FIG. 1E).

Subsequently, while filling the cavity 25 of the closed-die 20 with the material of the exposed portion 2 of the extruded raw material 1 exposed between the extrusion opening 15 of the extrusion nozzle 13 and the clamping portions 22 and 22 of both the divided members 21 and 21, in the state in which the extruded raw material 1 is clamped by and between the clamping portions 22 and 22 of both the divided member 21 and 21, namely, in the state in which both the divided members 21 and 21 are combined mutually, as shown in FIG. 1C and FIG. 1D, both the divided members 21 and 21 are moved with the driving device 30 in the forward direction with respect to the extrusion direction of the extruded raw material 1 at a speed slower than the extrusion speed with the driving device 30. Thereby, the exposed portion 2 of the extruded raw material 1 is expanded in diameter in the cavity 25 of the closed-die 20 [Diameter Expansion Step].

As mentioned above, while filling the cavity 25 of the closed-die 20 with the material of the exposed portion 2 of the extruded raw material 1, by moving both the divided members 21 and 21 in the forward direction with respect to the extrusion direction of the extruded raw material 1 at a speed slower than the extrusion speed, the flow of the material in the cavity 25 is distributed. Therefore, the corner portion of the cavity 25 of the closed-die 20 can be filled up with the material without excessively increasing the extrusion force of the extruder 11. Therefore, any defect that a non-filled up portion (i.e., a portion not filled up with the material) is generated in the cavity 25 can be prevented. Therefore, it is possible to prevent the generation of a defective shape, such as, underfill, resulting in a high quality upsetting manufactured product 5.

Furthermore, since the corner portion in the cavity 25 of the closed-die 20 can be filled up with the material without excessively increasing the extrusion pressure of the extruder 11, the load applied to the closed-die 20 during the processing can be reduced. Therefore, the service life of the closed-die 20 can be extended.

In the present invention, it is necessary and sufficient that the traveling speed of both the divided members 21 and 21 driven by the driving device 30 is slower than the extrusion speed of the extruded raw material 1, i.e., less than 1 time to the extrusion speed of the extruded raw material 1. The speed difference of the traveling speed of both the divided members 21 and 21 and the extrusion speed of the extruded raw material 1 can be defined depending on the shape of the diameter expanded portion 6, i.e., the shape of the cavity 25. Moreover, the speed difference can be fixed or changed. For example, the speed difference can be increased at the portion where the amount of the diameter expansion is large, and the speed difference can be decreased at the portion where the amount of the diameter expansion is small. That is, the traveling speed of both the divided members 21 and 21 is arbitrarily set depending on the shape of the cavity 25 of the closed-die 20, and can be set to a speed at which the cavity 25 can be filled up with the material so as not to cause a non-filled up portion in the cavity 25.

Here, at the clamping step, it is preferable to clamp the extruded raw material 1 with the clamping portions 22 and 22 of both the divided members 21 and 21 at the position where the length of the exposed portion 2 of the extruded raw material 1 is less than the buckling limit length of the exposed portion 2. With this, the buckling of the extruded raw material 1 can be prevented assuredly, and the exposed portion 2 of the extruded raw material 1 can be favorably expanded in diameter.

At the diameter expansion step, it is preferable to set a time lag between the initiation of clamping the extruded raw material 1 with the clamping portions 22 and 22 of both the divided member 21 and 21 and the initiation of moving both the divided members 21 and 21. That is, as shown in FIG. 1B, at the clamping step, the extrude draw material 1 is clamped by and between the clamping portions 22 and 22 of both the divided members 21 and 21. While keeping the clamping state, i.e., while keeping the state in which both the divided members 21 and 21 are combined with each other, both the divided members 21 and 21 are made to stand-by at the position (i.e., initial position) without moving both the divided members 21 and 21. This stand-by time corresponds to the time lag. Then, as shown in FIG. 1C, during this time lag, the exposed portion 2 of the extruded raw material 1 is slightly expanded in diameter in the cavity 25. After the time lag has passed, as shown in FIG. 1D, both the divided members 21 and 21 are moved in the forward direction with respect to the extrusion direction of the extruded raw material 1 at a speed slower than the extrusion speed. By setting the time lag as mentioned above, the cross-sectional area of the exposed portion 2 of the extruded raw material 1 can be increased at the early stage of the diameter expansion. Therefore, the buckling limit length of the exposed portion 2 can be increased, which in turn can prevent buckling more assuredly.

At the diameter expansion step, when the material of the exposed portion 2 of the extruded raw material 1 is completely introduced into the cavity 25 of the closed-die 20 to form a designed shape (see FIG. 1D), the traveling speed of both the divided members 21 and 21 is conformed to (i.e., synchronized with) the extrusion speed of the extruded raw material 1, and both the divided members 21 and 21 are separated by moving both the divided members 21 and 21 in the separation direction with the divided member combining device 200 as shown in FIG. 1E. This releases the clamping of the extruded raw material 1 by the clamping portions 22 and 22 of both the divided member 21 and 21 [Clamp Releasing Step]. Then, the diameter expanded portion 6 of the extruded raw material 1 moves in the forward direction with respect to the extrusion direction by the extrusion force of the extruder 1. In this embodiment, as shown in FIG. 1D, when the exposed portion 2 of the extruded raw material 1 is expanded into a designed shape, the position of the extrusion opening 15 of the extrusion nozzle 13 and the position of the rear end of the cavity 25 are coincided with each other. In the present invention, however, when the exposed portion 2 of the extruded raw material 1 is expanded into a designed shape, the position of the extrusion opening 15 of the extrusion nozzle 13 can be positioned ahead of the rear end of the cavity 25. In this case, the material of the exposed portion 2 fills the cavity 25 in a manner such that the material surrounds the outside of the tip end portion of the extrusion nozzle 13. Furthermore, in this case, it is preferable that the tip end portion of the external peripheral surface of the extrusion nozzle 13 is formed into an inwardly tapered shape toward its tip end since the tip end portion of the extrusion nozzle 13 can be easily pulled out from the material in the cavity 25.

Thereafter, as shown in FIG. 1E and FIG. 1F, both the divided member 21 and 21 are returned (moved) to their initial positions by the driving device 30 while keeping the separated state [Return Step].

Then, as shown in FIG. 1G, both the divided member 21 and 21 are combined by the divided member combining device 200 to thereby form the closed-die 20 again and simultaneously clamp the extruded raw material 1 with the clamping portions 22 and 22 of both the divided members 21 and 21 [Clamping Step]. Then, the diameter expansion step, the clamp releasing step, and the return step mentioned above are repeated in this order.

In this embodiment, while the clamping step, the diameter expansion step, the clamp releasing step, and the return step are repeatedly performed, the extruded raw material 1 is continuously being extruded from the extrusion opening 15 of the extrusion nozzle 13 at a predetermined speed. In the present invention, however, during these steps, the extrusion of the extruded raw material 1 can be stopped. Moreover, the extrusion speed of the extruded raw material 1 can be constant, or can be changed.

In cases where the upsetting is repeated as mentioned above, even at the second and subsequent diameter expansion step, in the same manner as in the first diameter expansion step, a time lag is set between the initiation of clamping the extruded raw material 1 by the clamping portions 22 and 22 of both the divided members 21 and 21 and the initiation of moving both the divided members 21 and 21. During this time lag, as shown in FIG. 1G, the clamped portion 3 (i.e., the previously clamped portion 3) of the extruded raw material 1 clamped by and between the clamping portions 22 and 22 of both the divided members 21 and 21 at the previous diameter expansion step which is a portion located ahead of the clamped portion 3 (i.e., the currently clamped portion 3) of the extruded raw material 1 clamped by and between the clamping portions 22 and 22 of both the divided member 21 and 21 is cut (i.e., sheared) with the cutting device 40 [Cutting Step]. This cutting process will be detailed as follows. That is, the cutting blade 41 and the cutting die 42 of the cutting device 40 are moved so as to approach with each other to clamp the cutting scheduled portion (i.e., the previously clamped portion 3) of the extruded raw material 1 by and between the cutting blade 41 and the cutting die 42, and then the cutting scheduled portion is cut with the cutting blade 41. In cases where this cutting step is performed at the third or subsequent diameter expansion step, the diameter expanded portion 6 will be separated from the extruded raw material 1.

In this embodiment, the cutting scheduled portion of the extruded raw material 1 is the clamped portion 3 of the extruded raw material 1 clamped by and between the clamping portions 22 and 22 of both the divided members 21 and 21 at the previous diameter expansion step as mentioned above. Since a bite mark 7 is formed at this clamped portion 3, this clamped portion 3 can be easily cut as a cutting scheduled portion with the cutting device 40. In the present invention, it is preferable that the slip prevention means is a means capable of forming a bite mark which facilitates the cutting operation. As such a slip prevention means, a biting protrusion of a V-shaped cross-section (e.g., a wedge shape) formed on the clamping portion 22 of the divided member 21 and/or a biting protrusion capable of forming a bite mark (preferably, a biting protrusion of a V-shaped cross-section) having a length more than half of the entire peripheral length of the clamped portion 3 thereon formed on the clamping portions 22 and 22 of both the divided members 21 and 21, can be exemplified.

By performing this cutting step every diameter expansion step, an upsetting manufactured product 5 having one diameter expanded portion 6 as shown in FIG. 3 can be obtained. If this cutting step is performed every other diameter expansion step or every three or more diameter expansion step among the diameter expansion steps to be repeatedly performed, an upsetting manufactured product having two or more diameter expanded portions 6 (not illustrated) can be obtained.

The upsetting manufactured product 5 obtained as mentioned above can be used as a preform having a shape as close as possible to the desired product shape.

According to the upsetting method of the above-mentioned embodiment, the step for manufacturing an extruded raw material 1 and the step for upsetting the extruded raw material 1 can be performed continuously. Therefore, the productivity of the upsetting manufactured product 5 can be improved.

Furthermore, since the extrusion force of the extruder 11 is used as a force for pressurizing the extruded raw material 1 in the axial direction to expand the diameter of the exposed portion 2 (i.e., the diameter expansion scheduled portion) of the extruded raw material 1, a punch and its driving device for pressurizing a raw material in the axial direction, which was used in a conventional upsetting method, are not required separately. This simplifies the upsetting apparatus 10.

Since the exposed portion 2 of the extruded raw material 1 is expanded in diameter in the cavity 25 of the closed-die 20, the preform having a shape as close as possible to the desired product shape can be manufactured, which can improve the material yield and reduce the number of manufacturing steps.

Moreover, the clamping step, the diameter expansion step, the clamp releasing step, and the return step are performed repeatedly in order, which can further improve the productivity of the upsetting manufactured product 5.

Furthermore, by cutting the extruded raw material 1 during the time lag, the following effects can be attained. That is, if the cutting scheduled portion of the extruded raw material 1 is moving at the time of cutting the cutting scheduled portion, various problems such as, e.g., deformation of a cut end or a cut section, may occur. Therefore, in order to solve such problems, in this embodiment, the cutting of the extruded raw material 1 is performed during the time lag. With this, since the cutting scheduled portion of the extruded raw material 1 is not moving at the time of cutting the cutting scheduled portion of the extruded raw material 1, the cutting scheduled portion can be cut well without causing such problems, and the cutting scheduled portion can be cut easily as well.

Furthermore, since the cutting of the extruded raw material 1 can be performed while extruding the extruded raw material 1 with the extruder 11, the space for installing the upsetting apparatus 10 can be saved.

Moreover, since the biting protrusion 23 for biting the extruded raw material 1 is provided at each of the clamping portions 22 and 22 of both the divided member 21 and 21 as a slip prevention means, the slip of the extruded raw material 1 can be prevented and the extruded raw material 1 can be clamped assuredly.

Since the extruded raw material 1 would not be buckled, a high quality upsetting manufactured product free from defective shapes, such as, e.g., wrinkles or scratches, can be provided.

Although the above explanation is directed to one embodiment of the present invention, the present invention is not limited to the aforementioned embodiment.

For example, in the present invention, a cutting blade can be provided at the clamping portion 22 of at least one divided member 21 of both the divided members 21 and 21 as a cutting device, so that the cutting blade cuts the clamped portion 3 of the extruded raw material 1 in the state in which the extruded raw material 1 is clamped by both the clamping portions 22 and 22 of both the divided member 21 and 21.

Furthermore, in the present invention, the dividing number of the closed-die 20 is not limited to two, and can be three, four, or more.

Moreover, in the aforementioned embodiment, the extruding direction of the extruded raw material 1 by the extruder 11 is horizontal. In the present invention, however, the extruding direction of the extruded raw material 1 can be, for example, a vertical direction such as a downward direction.

Moreover, in the aforementioned embodiment, at the diameter expansion step, the position of the extrusion opening 15 of the extrusion nozzle 13 is fixed, and the exposed portion 2 of the extruded raw material 1 is expanded in the cavity 25 by moving the plurality of divided members 21 and 21 in the forward direction with respect to the extrusion direction of the extruded raw material 1 at a speed slower than the extrusion speed in the state in which the extruded raw material 1 is clamped by and between the clamping portions 22 and 22 of the plurality of divided members 21 and 21. In the present invention, however, in addition to the above, at the diameter expansion step, in the state in which the extruded raw material 1 is clamped by and between the clamping portions 22 and 22 of the plurality of divided members 21 and 21 with the positions of the divided members 21 and 21 fixed, the exposed portion 2 of the extruded raw material 1 can be expanded in the cavity 25 by moving the extrusion opening 15 of the extrusion nozzle 13 in the rearward direction with respect to the extrusion direction of the extruded raw material 1 at a speed slower than the extrusion speed.

The above-mentioned two upsetting methods can be summarized as follows. Namely, in the present invention, at the diameter expansion step, while filling the cavity 25 with the material of the exposed portion 2 of the extruded raw material 1 exposed between the extrusion opening 15 of the extrusion nozzle 13 and the clamping portions 22 and 22 of the plurality of divided members 21 and 21 by extruding the extruded raw material from the extrusion opening 15 by the extruder 11, in the state in which the extruded raw material 1 is clamped by and between the clamping portions 22 and 22 of the plurality of divided members 21 and 21, the exposed portion 2 of the extruded raw material 1 is expanded in diameter in the cavity by moving the plurality of divided members 21 and 21 in the forward direction with respect to the extrusion direction of the extruded raw material 1 relative to the extrusion opening 15 of the extrusion nozzle 13 at a speed slower than the extrusion speed Moreover, in the aforementioned embodiment, the driving device is for moving both the divided members 21 and 21 in the forward direction with respect to the extrusion direction of the extruded raw material 1 at a speed slower than the extrusion speed with the divided members 21 and 21 combined. Moreover, this driving device 30 is configured to return (move) both the divided members 21 and 21 moved in the forward direction with respect to the extrusion direction of the extruded raw material 1 to the initial position. In the present invention, however, other than the above, the driving device 30 can be for moving the extrusion opening 15 of the extrusion nozzle 13 in the rearward direction with respect to the extrusion direction of the extruded raw material 1 at a speed slower than the extrusion speed. Furthermore, in this case, the driving device 30 can be configured to return (move) the extrusion opening 15 of the extrusion nozzle 13 in the rearward direction with respect to the extrusion direction of the extruded raw material 1 to the initial position.

The aforementioned upsetting apparatus can be summarized as follows. That is, in the present invention, the driving device 30 can be for moving the plurality of divided members 21 and 21 in the forward direction with respect to the extrusion direction of the extruded raw material 1 by the extruder 11 relative to the extrusion opening 15 of the extrusion nozzle 13 at a speed slower than the extrusion speed. Furthermore, the driving device 30 can be configured to return the plurality of divided members 21 and 21 moved in the forward direction with respect to the extrusion direction of the extruded raw material 1 relative to the extrusion opening 15 of the extrusion nozzle 13 to the initial position.

Furthermore, a supporting member (not illustrated) for supporting the extruded raw material 1 can be arranged between both the divided members 21 and 21 (i.e., the closed-die 20) and the cutting device 40, as a means for preventing bending (e.g., deflection) due to its own weight, etc., of the extruded raw material 1. In this case, it is preferable that the supporting member can be moved together with the extruded raw material 1.

Moreover, in the present invention, the upsetting can be performed with mold release agent or lubricant applied to the inner surface of the cavity 25 of the closed-die 20.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example;" and "NB" which means "note well."

INDUSTRIAL APPLICABILITY

The present invention can be applied to an upsetting method and an upsetting apparatus used in manufacturing a product having a diameter expanded portion, such as, e.g., an arm, a connecting rod, or a piston for vehicles (cars, railroad vehicles, etc.).

What is claimed is:

1. An upsetting method using an extruder equipped with an extrusion nozzle having an extrusion opening at a tip end portion of the extrusion nozzle and a closed-die having a cavity, the closed-die being divided into a plurality of closed-die divided members, the upsetting method, comprising:

a clamping step of forming the closed-die by combining the plurality of closed-die divided members so that the tip end portion of the extrusion nozzle is arranged in the cavity with an extruded raw material extruded from the extrusion opening of the extrusion nozzle of the extruder and clamping the extruded raw material with clamping portions provided at the plurality of closed-die divided members; and a diameter expansion step of extruding the extruded raw material from the extrusion opening of the extrusion nozzle with the extruder and expanding an exposed portion of the extruded raw material exposed between the extrusion opening of the extrusion nozzle and the clamping portions of the plurality of divided members while filling the cavity with a material of the exposed portion by moving the plurality of closed-die divided members in a forward direction with respect to an extrusion direction of the extruded raw material relative to the extrusion opening of the extrusion nozzle at a speed slower than an extrusion speed with the extruded raw material clamped by and between the clamping portions of the plurality of divided members.

2. The upsetting method as recited in claim 1, wherein at the clamping step, the extruded raw material is clamped by and between the clamping portions of the plurality of divided members at a position where a length of the exposed portion of the extruded raw material is not longer than a buckling limit length of the exposed portion.

3. The upsetting method as recited in claim 1, wherein at the diameter expansion step, a time lag is set between initiation of clamping the extruded raw material by the clamping portions of the plurality of divided members at the clamping step and initiation of moving the plurality of divided members.

4. The upsetting method as recited in claim 3, wherein a clamped portion of the extruded raw material or a portion of the extruded raw material located ahead of the clamped portion is cut during the time lag with the extruded material clamped by and between the clamping portions of the plurality of divided members.

5. The upsetting method as recited in any one of claims 1 to 4, wherein a slip prevention means is provided at the clamping portion of at least one of the plurality of divided members.

6. The upsetting method as recited in claim 5, wherein a biting protrusion for biting the extruded raw material as the slip prevention means is provided at the clamping portion of at least one of the plurality of divided members.

7. The upsetting method as recited in any one of claims 1 to 4, further comprising:

a clamp release step of releasing clamping of the extruded raw material by the clamping portions of the plurality of divided members after the diameter expansion step; and a return step of returning the plurality of divided members to the initial position after the clamp releasing step, wherein the clamping step, the diameter expansion step, the clamp releasing step, and the return step are repeatedly performed in order.

8. An upsetting manufactured product obtained by the upsetting method as recited in claim 1.

9. An upsetting apparatus, comprising:

an extruder provided with an extrusion nozzle having an extrusion opening at a tip end portion of the extrusion nozzle, an extruded raw material being extruded from the extrusion opening of the extrusion nozzle;

a closed-die having a cavity, the closed-die being divided into a plurality of closed-die divided members;

a divided member combining device for combining the plurality of closed-die divided members so that the closed-die is formed; and a driving device for moving the plurality of divided members in a forward direction with respect to an extrusion direction of the extruded raw material by the extruder relative to the extrusion opening of the extrusion nozzle at a speed slower than an extrusion speed with the plurality of divided members combined, wherein the plurality of divided members are provided with a clamping portion, respectively, and wherein the extruded material is clamped by the clamping portions of the plurality of divided members when the plurality of divided members are combined by the divided member combining device.

10. The upsetting apparatus as recited in claim 9, further comprising a cutting device for cutting a clamped portion of the extruded raw material clamped by and between the clamping portions of the plurality of divided members or a portion of the extruded raw material located ahead of the clamped portion.

11. The upsetting apparatus as recited in claim 9 or 10, wherein the clamping portion of at least one of the plurality of divided members is provided with a slip prevention means.

12. The upsetting apparatus as recited in claim 11, wherein the clamping portion of at least one of the divided members is provided with a biting protrusion for biting the extruded raw material as the slip prevention means.

13. The upsetting apparatus as recited in claim 9 or 10, wherein the divided member combining device is further configured to detach the plurality of divided members combined each other, and wherein the driving device is further configured to return the plurality of divided members moved in the forward direction with respect to the extrusion direction of the extruded raw material relative to the extrusion opening of the extrusion nozzle to their initial positions.

* * * * *